US009726997B2

(12) United States Patent
Fujita et al.

(10) Patent No.: US 9,726,997 B2
(45) Date of Patent: Aug. 8, 2017

(54) ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING APPARATUS

(71) Applicant: FUJI XEROX CO., LTD., Tokyo (JP)

(72) Inventors: Asafumi Fujita, Kanagawa (JP); Narumasa Sato, Kanagawa (JP); Eisuke Iwazaki, Kanagawa (JP); Tomoaki Tanaka, Kanagawa (JP); Kotaro Yoshihara, Kanagawa (JP); Noriyuki Mizutani, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 14/600,726

(22) Filed: Jan. 20, 2015

(65) Prior Publication Data

US 2016/0026104 A1 Jan. 28, 2016

(30) Foreign Application Priority Data

Jul. 25, 2014 (JP) ..... 2014-152052

(51) Int. Cl.
*G03G 9/08* (2006.01)
*G03G 9/097* (2006.01)

(52) U.S. Cl.
CPC ..... *G03G 9/09725* (2013.01); *G03G 9/0819* (2013.01); *G03G 9/0825* (2013.01); *G03G 9/09708* (2013.01); *G03G 9/09733* (2013.01)

(58) Field of Classification Search
CPC ..... G03G 9/0825; G03G 9/09733; G03G 9/09725
USPC ..... 430/110.1
See application file for complete search history.

(56) References Cited

U.S. PATENT DOCUMENTS

2001/0005568 A1* 6/2001 Sokol ..... G03G 9/08711 430/108.24
2003/0049554 A1 3/2003 Ohmura et al.
2003/0091920 A1 5/2003 Yamauchi et al.
2006/0216628 A1 9/2006 Nakamura et al.
2006/0240349 A1* 10/2006 Watanabe ..... G03G 9/0806 430/108.4
2007/0009823 A1* 1/2007 Skorokhod ..... G03G 9/0806 430/108.3
2011/0262853 A1* 10/2011 Watanabe ..... G03G 9/0804 430/108.4

(Continued)

FOREIGN PATENT DOCUMENTS

JP 2002-351123 A 12/2002
JP 2003-167371 A 6/2003

(Continued)

OTHER PUBLICATIONS

Communication dated Apr. 4, 2017, issued by the Japan Patent Office in corresponding Japanese Application No. 2014-152052.

*Primary Examiner* — Christopher Rodee
(74) *Attorney, Agent, or Firm* — Sughrue Mion, PLLC

(57) ABSTRACT

An electrostatic charge image developing toner includes toner particles containing crosslinked resin particles having a glass transition temperature of 55° C. or higher in a surface layer of the toner particle, and silica particles having a volume average particle diameter of 30 nm to 300 nm and a coverage with respect to the toner particle from 50% to 100%.

15 Claims, 2 Drawing Sheets

(56) References Cited

U.S. PATENT DOCUMENTS

2011/0318053 A1* 12/2011 Yamashita ..... G03G 9/0804
399/112

FOREIGN PATENT DOCUMENTS

| | | | |
|---|---|---|---|
| JP | 2005266563 | A | 9/2005 |
| JP | 2006267231 | A | 10/2006 |
| JP | 2010-60599 | A | 3/2010 |
| JP | 2010-134024 | A | 6/2010 |
| JP | 2012163694 | A | 8/2012 |

* cited by examiner

ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-152052 filed Jul. 25, 2014.

BACKGROUND

1. Technical Field

The present invention relates to an electrostatic charge image developing toner, an electrostatic charge image developer, a toner cartridge, a process cartridge, and an image forming apparatus.

2. Related Art

A method of visualizing image information through an electrostatic charge image, such as electrophotography, is currently used in various fields. In electrophotography, an electrostatic charge image formed on a photoreceptor through a charging process and an electrostatic charge image forming process is developed by a developer including a toner and is visualized through a transfer process and a fixing process.

SUMMARY

According to an aspect of the invention, there is provided an electrostatic charge image developing toner including:

toner particles containing crosslinked resin particles having a glass transition temperature of 55° C. or higher in a surface layer of the toner particle; and silica particles having a volume average particle diameter of 30 nm to 300 nm and a coverage with respect to the toner particle from 50% to 100%.

BRIEF DESCRIPTION OF THE DRAWINGS

Exemplary embodiments of the present invention will be described in detail based on the following figures, wherein.

DETAILED DESCRIPTION

Hereinafter, exemplary embodiments which are examples of the invention will be described in detail.

Electrostatic Charge Image Developing Toner

Figure 3:
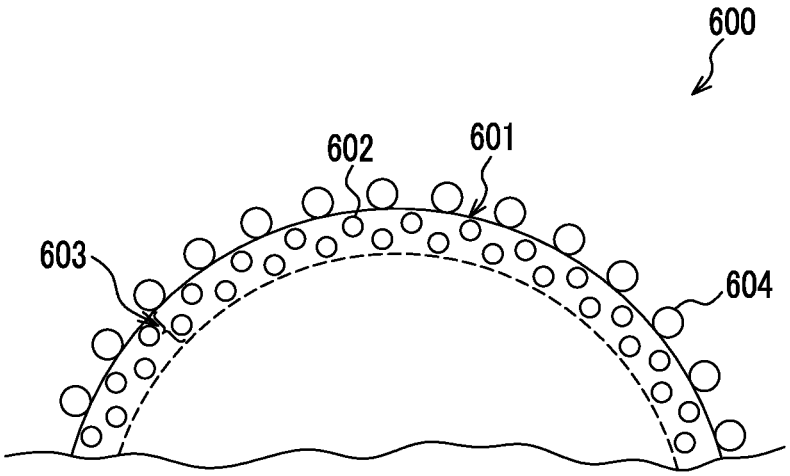
FIG. 3 is a schematic configuration diagram showing an example of an electrostatic charge image developing toner according to the exemplary embodiment.

FIG. 3 is a schematic configuration diagram showing an example of an electrostatic charge image developing toner according to the exemplary embodiment.

As shown in FIG. 3, the electrostatic charge image developing toner according to the exemplary embodiment (hereinafter, referred to as a "toner" in some cases) includes toner particles containing crosslinked resin particles in a surface layer portion and silica particles which are externally added to the toner particles. In FIG. 3, reference numeral 600 denotes the toner, reference numeral 601 denotes the toner particles, reference numeral 602 denotes the crosslinked resin particles, reference numeral 603 denotes the surface layer portion, and reference numeral 604 denotes the silica particles.

A glass transition temperature (Tg) of the crosslinked resin particles is equal to or higher than 55° C. The silica particles have a volume average particle diameter of 30 nm to 300 nm and a coverage with respect to the toner particles of 50% to 100%.

Herein, mechanical load due to stirring when stirring toner in a developing unit (for example, a developing device) and due to cleaning when removing residual toner by a cleaning unit (for example, a cleaning blade), or thermal load due to temperature rising in the image forming apparatus, is applied to the toner used in the image forming apparatus. It has been known that, when such a load is applied to the toner, the external additive is embedded in the toner particle. The external additive is originally used for preventing adhesion of the toner particles to each other and improving fluidity of the toner, but when the external additive is embedded, these functions of the external additive are hardly obtained.

Particularly, in an image forming apparatus using a recycling mechanism (toner reclaiming method) which supplies the toner removed by the cleaning unit to the developing unit, when the mechanical load and the thermal load are applied to the toner, thermal fixing of the toner particles to each other in a supply flow path for the collected toner towards the developing unit easily occurs, and clogging easily occurs in the supply flow path.

Therefore, in the toner according to the exemplary embodiment, the crosslinked resin particle having a glass transition temperature equal to or higher than 55° C. is contained in the surface layer portion of the toner particle, and the silica particles having a volume average particle diameter of 30 nm to 300 nm and a coverage with respect to the toner particles of 50% to 100% are externally added thereto. Accordingly, in the toner reclaiming method, the clogging in the supply flow path when supplying the collected toner to the developing unit is prevented.

The reason thereof is not clear, but the following reasons are considered.

Since the crosslinked resin particle having the glass transition temperature equal to or higher than 55° C. exists in the surface layer portion of the toner particles (preferably an area within a depth of 300 nm from the surface), a decrease in viscosity of the surface of the toner particle is prevented, even when the temperature in the image forming apparatus is increased (for example, from 25° C. to 50° C.). In addition, since a filling effect (filler effect) due to the crosslinked resin particles is obtained in the surface layer portion, elasticity of the surface of the toner particle easily increases. Since the crosslinked resin particle existing in the surface layer portion has hardness, mechanical strength of the surface of the toner particle increases, and the external additive is prevented from being embedded in the toner particle.

As a result, even when the thermal load and the mechanical load are applied to the toner, the adhesion of the toner particles to each other is prevented.

In the toner according to the exemplary embodiment, the crosslinked resin particles are included in the surface layer portion of the toner particle, and the silica particles having a specific volume average particle diameter and a specific coverage are externally added thereto, as described above. Thus, the fluidity of the toner which is an original function of the toner is obtained.

As described above, when the toner according to the exemplary embodiment is applied to the image forming apparatus using the toner reclaiming method, the original function of the toner is ensured, and the clogging of the collected toner in the supply flow path towards the developing unit is prevented.

In addition, since the toner particle contains particulates which are the crosslinked resin particles in the surface layer portion and an area excluding the area of the crosslinked resin particles is configured with a normal toner particle component (for example, binder resin), the inhibition of fixability is also prevented.

Hereinafter, the toner according to the exemplary embodiment will be described in detail.

Toner Particles

The toner particle according to the exemplary embodiment is, for example, configured to include a binder resin, and if necessary, a colorant, a release agent, and other additives, and includes the crosslinked resin particles in the surface layer portion.

Crosslinked Resin Particles

The crosslinked resin particles are particles containing crosslinked resin. Specific examples of the crosslinked resin include a crosslinked polymer obtained by polymerizing and crosslinking a monomer including at least one kind or plural kinds of a polymerizable monomer having a vinyl double bond, with a crosslinking agent; a crosslinked polymer obtained by causing a crosslinking reaction by a crosslinking agent with respect to a polymer of a monomer including at least one kind or plural kinds of the polymerizable monomer; and a crosslinked polymer obtained from a resin which performs self crosslinking due to heat or a catalyst (hereinafter, also referred to as a "self-crosslinking resin").

As the polymerizable monomer having vinyl double bond, a monomer containing a radical polymerizable vinyl group is used, for example.

Examples of the monomer containing a radical polymerizable vinyl group include an aromatic vinyl monomer, a (meth)acrylic acid, a (meth)acrylic acid ester monomer, a vinyl ester monomer, a vinyl ether monomer, a monoolefin monomer, a diolefin monomer, and a halogenated olefin monomer. Among these, from a viewpoint of affinity with the binder resin, an aromatic vinyl monomer, a (meth)acrylic acid, or a (meth)acrylic acid ester monomer is preferably used. (meth)acryl means any one of acryl and methacryl or both of them.

Examples of the aromatic vinyl monomer include styrene monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene or derivatives thereof.

Examples of the (meth)acrylic acid ester monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, γ-amino propyl acrylate, stearyl methacrylate, dimethylaminoethyl acrylate, dimethylaminoethyl methacrylate, diethylaminoethyl acrylate, and diethylaminoethyl methacrylate.

Examples of the vinyl ester monomer include vinyl acetate, vinyl propionate, and vinyl benzoate.

Examples of the vinyl ether monomer include vinyl methyl ether, vinyl ethyl ether, vinyl isobutyl ether, and vinyl phenyl ether.

Examples of the monoolefin monomer include ethylene, propylene, isobutylene, 1-butene, 1-pentene, and 4-methyl-1-pentene.

Examples of the diolefin monomer include butadiene, isoprene, and chloroprene.

Examples of the halogenated olefin monomer include vinyl chloride, vinylidene chloride, and vinyl bromide.

These monomers may be used alone or in combination of two or more kinds thereof.

The polymerization of these monomers may be performed using a chain-transfer agent. The chain-transfer agent is not particularly limited, and a compound having a thiol component is used, for example.

The crosslinking agent is, for example, a crosslinkable monomer having two or more polymerizable carbon-carbon unsaturated double bonds. Examples of the crosslinkable monomer include an aromatic divinyl compound such as divinyl benzene, divinyl naphthalene, and a derivative thereof; divinyl ester compound of carboxylic acid such as divinyl adipate, divinyl succinate, divinyl fumarate, divinyl maleate, divinyl glutarate, divinyl pimelate, divinyl suberate, divinyl azelate, divinyl sebacate, divinyl dodecanoate, and divinyl brassilate; a compound including two vinyl groups in a molecule such as a dimethacrylate compound such as ethylene glycol dimethacrylate or diethylene glycol dimethacrylate, and divinyl ether; and a compound including three or more vinyl groups in a molecule such as pentaerythritol triallyl ether and trimethylol propane triacrylate. These crosslinking agents may be used alone or in combination of two or more kinds thereof.

As the crosslinking agent, a compound having an epoxy group or an isocyanate group, or a metal compound is used, for example, when a carboxyl group is included in a functional group of the resin before the crosslinking (for example, a monomer containing at least one or plural kinds of monomer having the vinyl double bond or a polymer thereof).

Examples of the compound having an epoxy group include a compound having two or more epoxy groups, for example, ethylene glycol diglycidyl ether, polyethylene glycol diglycidyl ether, propylene glycol diglycidyl ether, polypropylene glycol diglycidyl ether, neopentyl glycol diglycidyl ether, glycerol triglycidyl ether, trimethylolpropane triglycidyl ether, 1,2-3,4-diepoxybutane, allyl glycidyl ether, glycidyl acrylate, β-methyl glycidyl acrylate, glycidyl methacrylate, and β-methyl glycidyl methacrylate.

Examples of the compound having an isocyanate group include a polyisocyanate compound, for example, tolylene diisocyanate, hydrogenated tolylene diisocyanate, diphenylmethane diisocyanate, xylene diisocyanate, hexamethylene diisocyanate, and a prepolymer having an isocyanate group (polymer having an isocyanate group at a terminal, which is obtained by causing an excessive amount of the polyisocyanate to react with polyol such as a hydroxyl group-containing polyester or hydroxyl group-containing polyether).

As the metal compound, a water-soluble metal compound having a di- or higher atom valence, and examples thereof include a halide, salts (carbonate, nitrate, or sulfate), oxide, or hydroxide of metal such as boron, aluminum, iron, copper, zinc, tin, titanium, nickel, magnesium, vanadium, chromium, or zirconium. Among these, boric acid, borax, aluminum chloride, aluminum sulfate, zirconium ammonium carbonate, zirconium chloride, or iron alum is particularly preferable.

As the crosslinking agent, a compound having a carboxyl group or an acid anhydride group, a compound having an aldehyde group, a compound having an epoxy group, a nitrogen-containing compound, a compound having an acrylamide part, a compound having an isocyanate group, and a metal compound are used, for example, when a hydroxyl group is included in a functional group of the resin before the crosslinking. Among these, the compound having a carboxyl group or an acid anhydride group (particularly, polyvalent carboxylic acid or anhydride thereof), and the metal compound are preferable.

Examples of polyvalent carboxylic acid include aliphatic polycarboxylic acid, alicyclic polycarboxylic acid, aromatic polycarboxylic acid, oxy polycarboxylic acid, and heterocyclic polyvalent carboxylic acid.

Examples of aliphatic polycarboxylic acid include aliphatic saturated polycarboxylic acid having 2 to 10 carbon atoms (for example, oxalic acid, malonic acid, succinic acid, glutaric acid, adipic acid, pimelic acid, suberic acid, azelaic acid, or sebacic acid), and aliphatic unsaturated polycarboxylic acid having 4 to 6 carbon atoms (fumaric acid, maleic acid, maleic anhydride, citraconic acid, mesaconic acid, or itaconic acid).

Examples of alicyclic polycarboxylic acid include alicyclic polycarboxylic acid having 8 to 10 carbon atoms (for example, 1,4-cyclohexane dicarboxylic acid, tetrahydrophthalic acid, or hexahydrophthalic acid).

Examples of aromatic polycarboxylic acid include aromatic polycarboxylic acid having 8 to 12 carbon atoms or acid anhydride thereof (for example, phthalic acid, phthalic anhydride, isophthalic acid, terephthalic acid, trimellitic acid, or pyromellitic acid).

Examples of oxy polycarboxylic acid include oxy polyvalent carboxylic acid having 3 to 6 carbon atoms (for example, tartronic acid, malic acid, tartaric acid, or citric acid).

Examples of heterocyclic polyvalent carboxylic acid include polyvalent carboxylic acid having at least one kind of hetero atom selected from a nitrogen atom, an oxygen atom, and a sulfur atom (for example, pyridine dicarboxylic acid, pyridine tricarboxylic acid, pyridine tetracarboxylic acid, or tropic acid). As polyvalent carboxylic acid in this heterocyclic polyvalent carboxylic acid, aliphatic, alicyclic, or aromatic polycarboxylic acid (particularly, polycarboxylic acid having 3 to 10 carbon atoms) is preferably used.

Herein, as polyvalent carboxylic acid, salt or partial salt of polyvalent carboxylic acid is also used. As polyvalent carboxylic acid salt, an inorganic salt such as ammonium salt or alkali metal salt (potassium salt or sodium salt), and organic salt such as tertiary amine are included. As polyvalent carboxylic acid, maleic acid or anhydride thereof (maleic anhydride) is particularly preferable.

As the compound having an aldehyde group, a compound having plural aldehyde groups, for example, glyoxal, malonaldehyde, glutaraldehyde, terephthalic aldehyde, dialdehyde starch, or acrolein copolymerization acrylic resin is used.

Examples of the nitrogen-containing compound include alkoxy melamine such as methoxymethyl melamine, a methylol group-containing compound such as N-methylol melamine, or N-methylol urea; guanamines such as acetoguanamine or benzoguanamine; a melamine-formalin resin, and a urea-formalin resin.

Examples of the compound having an acrylamide group include methylene-bis(meth)acrylamide, N,N'-dimethylol-methylene-bis-acrylamide, and 1,1-bis-acrylamide-ethane.

As the compound having an epoxy group or an isocyanate group and the metal compound, the compounds described above are used.

A weight ratio of the resin before the crosslinking and the crosslinking agent is, for example, preferably from 0.05 parts by weight to 20 parts by weight and more preferably from 0.5 parts by weight to 10 parts by weight, with respect to 100 parts by weight of the resin before the crosslinking.

As the self-crosslinking resin, a polymer which has a monomer having at least a self-crosslinking group, specifically, for example, an epoxy group, a methylol group, a hydrolytically condensable group (silyl group, alkoxysilyl group), or an aziridinyl group as a constitutional unit is used.

As the monomer having an epoxy resin, glycidyl(meth) acrylate is used.

Examples of the monomer having a methylol group or a derivative thereof include N-methylol(meth)acrylamide and N-alkoxymethyl(meth)acrylamide.

Examples of the monomer having a hydrolytically condensable group include vinylalkoxysilanes such as vinyl trialkoxysilanes, vinyl dialkoxy methyl silane, vinyl alkoxy dimethyl silane, vinyl tris(2-methoxyethoxy) silane, divinyl dialkoxysilane, or divinyl di(2-methoxyethoxy) silane; vinyl acetoxysilanes such as vinyl diacetoxy methyl silane or vinyltriacetoxysilane; vinyl halosilanes such as vinylmethyldichlorosilane or vinyl trichlorosilane; allyl alkoxysilanes such as allyl trialkoxysilane; allyl halosilane such as allyltrichlorosilane; (meth)acryloyloxyalkyl alkoxysilanes such as 2-(meth)acryloyloxyethyl trialkoxysilane, 3-(meth)acryloyloxypropyl trialkoxysilane, 3-(meth)acryloyloxy propyl methyl dialkoxysilane, or 3-(meth)acryloyloxypropyl methyldichlorosilane.

Examples of the monomer having an aziridinyl group include 2-(1-aziridinyl)ethyl(meth)acrylate and 2-(1-aziridinyl)propyl(meth)acrylate. These monomers having the self-crosslinking group may be used alone or in combination of two or more kinds thereof.

Specific examples of the crosslinked polymer include a styrene crosslinked polymer, a (meth)acrylic crosslinked polymer, a styrene-(meth)acrylic crosslinked polymer, a vinyl ester crosslinked polymer, a vinyl ether crosslinked polymer, and an olefin crosslinked polymer. Among these, the styrene crosslinked polymer, the (meth)acrylic crosslinked polymer, and the styrene-(meth)acrylic crosslinked polymer are preferable from a viewpoint of availability of the materials. These crosslinked polymers may be used alone or in combination of two or more kinds thereof.

Herein, the styrene crosslinked polymer is a crosslinked polymer which has a styrene monomer of at least 50% by weight or more as a constitutional unit. The styrene-(meth) acrylic crosslinked polymer is a crosslinked polymer which has a styrene monomer and a (meth)acrylic monomer with at least 50% by weight or more in total as a constitutional unit. Other crosslinked polymers are also defined in the same manner.

Characteristics of Crosslinked Resin Particles

A glass transition temperature (Tg) of the crosslinked resin particles is equal to or higher than 55° C., preferably from 55° C. to 80° C., and more preferably from 60° C. to 65° C. When the glass transition temperature thereof is set to be equal to or higher than 55° C., a decrease in viscoelasticiy of the surface of the toner particle is prevented even when the temperature in the image forming apparatus is increased, and the adhesion of the toner particles to each other is prevented. In order to prevent the decrease in viscoelasticity of the surface of the toner particle, a high glass transition temperature is preferable, but the upper limit thereof is preferably 65° C., in order to ensure the fixability of the toner.

The glass transition temperature of the crosslinked resin particle is measured by a method based on ASTMD 3418-82, when the measurement is performed using a differential scanning calorimeter (DSC) at a temperature rising rate of 10° C./min from −80° C. to 150° C.

A volume average particle diameter D50v of the crosslinked resin particles is preferably from 70 nm to 300 nm and more preferably from 90 nm to 150 nm. When the volume average particle diameter of the crosslinked resin particles is set to be from 90 nm to 150 nm, the filling effect due to the crosslinked resin particles is easily obtained.

The measurement of the volume average particle diameter of the crosslinked resin particles is performed by image analysis of an image of the cross section of the toner particle using a scanning electron microscope (SEM: S-4800 manufactured by Hitachi High-Technologies Corporation).

Specifically, first, the toner particle to be a measurement target is embedded in an epoxy resin and the epoxy resin is solidified. This solidified material is sliced to have a thickness of 100 nm by a microtome. The cross section of the toner particle of the slice is observed at 10 visual fields (10,000 magnification) using the scanning electron microscope. Regarding 100 crosslinked resin particles observed at each visual field, the maximum diameter and the minimum diameter for each particle are measured, and an equivalent spherical diameter is measured from a median value thereof. A diameter with the cumulative frequency of 50% of the obtained equivalent spherical diameter (D50v) is set as the volume average particle diameter of the crosslinked resin particles.

When the polyester resin is used as the binder resin, the cross section of the toner particle of the slice is preferably subjected to ruthenium dyeing, in order to easily identify the crosslinked resin particles.

A weight average molecular weight Mw of the crosslinked resin particles is preferably from 30,000 to 200,000 and more preferably from 40,000 to 100,000.

A number average molecular weight (Mn) of the crosslinked resin particles is preferably from 5,000 to 40,000 and more preferably from 5,500 to 35,000.

Molecular weight distribution Mw/Mn of the crosslinked resin particles is preferably from 2.0 to 6.0 and more preferably from 2.5 to 5.5.

The weight average molecular weight and the number average molecular weight are measured by gel permeation chromatography (GPC). The molecular weight measurement by GPC is performed with a THF solvent using HLC-8120 GPC which is a GPC manufactured by Tosoh Corporation as a measurement device and a TSKGEL SUPER HM-M (15 cm) which is a column manufactured by Tosoh Corporation. The weight average molecular weight and the number average molecular weight are calculated from results of this measurement using a calibration curve of molecular weights created with monodisperse polystyrene standard samples.

Binder Resin

Examples of the binder resins include a vinyl resin formed of a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination with two or more kinds thereof.

Among the binder resins described above, the polyester resin is preferable, from the viewpoint of easy formation of the crosslinked resin particles. Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC). More specifically, the glass transition temperature is acquired by "extrapolating glass transition starting temperature" disclosed in a method of acquiring the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using a GPC•HLC-8120 GPC manufactured by Tosoh Corporation as a measurement device and a TSKGEL SUPER HM-M column (15 cm) manufactured by Tosoh Corporation. The weight average molecular weight and the number average molecular weight are calculated from results of this measurement using a calibration curve of molecular weights created with monodisperse polystyrene standard samples.

The polyester resin is obtained with a well-known preparing method. Specific examples thereof include a method of conducting a reaction at a polymerization temperature set to 180° C. to 230° C., if necessary, under reduced pressure in the reaction system, while removing water or alcohol generated during condensation.

When monomers of the raw materials do not dissolve or become compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

The content of the binder resin is, for example, preferably from 40% by weight to 95% by weight, more preferably from 50% by weight to 90% by weight, and even more preferably from 60% by weight to 85% by weight, with respect to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing Methods for Transition Temperatures of Plastics", from a DSC curve obtained by differential scanning calorimetry (DSC).

The content of the release agent is, for example, preferably from 1% by weight to 20% by weight and more preferably from 5% by weight to 15% by weight, with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) covering the core. In the toner particle according to the exemplary embodiment, the surface layer portion corresponds to the shell layer and the inner portion with respect to the surface layer portion corresponds to the core (core particle), and the core/shell structure is formed with both of them.

The surface layer portion is preferably an area within a depth of 300 nm from the surface of the toner particle. When the surface layer portion is the area within a depth of 300 nm from the surface of the toner particle, the crosslinked resin particles are easily formed in the surface layer portion.

In the surface layer portion, an area ratio of the area of the crosslinked resin particles and the area excluding the area of the crosslinked resin particles (area of the crosslinked resin particles/area excluding the area of the crosslinked resin particles) in a cross section is preferably from 0.1 to 0.5 and more preferably from 0.15 to 0.45. When the area ratio of the area of the crosslinked resin particles and the area excluding the area of the crosslinked resin particles is equal to or greater than 0.1, the external additive is more likely to be prevented from being embedded in the toner particle. Meanwhile, when the area ratio thereof is equal to or smaller than 0.5, the adhesion strength of the external additive to the toner particle increases, and the decrease in fluidity of the toner due to isolation of the external additive is more likely to be prevented.

The checking method of the position of the crosslinked resin particles is performed by image analysis of an image of the cross section of the toner particle using the scanning electron microscope (SEM: S-4800 manufactured by Hitachi High-Technologies Corporation).

Specifically, first, the toner particle to be a measurement target is embedded in an epoxy resin and the epoxy resin is solidified. This solidified material is sliced to have a thickness of 100 nm by a microtome. The cross section of the toner particle of the slice is observed at 10 visual fields (10,000 magnification) using the scanning electron microscope, and the position of the crosslinked resin particles in the surface layer portion is checked from the image observed at each visual field.

When the polyester resin is used as the binder resin, the cross section of the toner particle of the slice is preferably subjected to ruthenium dyeing, in order to easily identify the crosslinked resin particles.

The measurement of the area ratio (area of the crosslinked resin particles/area excluding the area of the crosslinked resin particles) is performed by the following method. The sliced sample is dyed with osmium tetroxide in a desiccator at 30° C. for 3 hours. Then, an SEM image of the dyed sliced sample is obtained using an ultrahigh-resolution field-emission scanning electron microscope (S-4800 manufactured by Hitachi High-Technologies Corporation). Herein, since the polyester resin, the crosslinked resin particles, and the release agent are easily dyed with osmium tetroxide in this order, each component is identified by shading caused by dyed degrees. In a case where the shading is difficult to determine due to the state of the sample, the dyeing time may be adjusted.

In the cross section of the toner particle of the SEM image, the dyed crosslinked resin particles (domain thereof) are observed, an area of the crosslinked resin particles and an area excluding the area of the crosslinked resin particles with respect to the entire toner particle are acquired, and a ratio thereof is calculated. The calculation is performed for 10 toner particles, and an average area thereof is set as the area ratio of the crosslinked resin particles.

The volume average particle diameter (D50v) of the toner particles is preferably from 2 μm to 10 μm, and more preferably from 4 μm to 8 μm.

Various average particle diameters and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $SF1=(ML^2/A)\times(\pi/4)\times 100$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer LUZEX (manufactured by Nireco Corporation) through a video camera to obtain maximum lengths and projected areas of 100 particles, values of SF1 are calculated through the foregoing expression, and an average value thereof is obtained.

External Additives

As external additives, at least silica particles and, if necessary, other particles are externally added to the toner particle according to the exemplary embodiment.

Silica Particles

The volume average particle diameter of the silica particles is from 30 nm to 300 nm, more preferably from 50 nm to 150 nm, and even more preferably from 50 nm to 120 nm. When the volume average particle diameter thereof is from 30 nm to 300 nm, the silica particles are hardly embedded in the toner particle. In addition, the isolation of the silica particles are prevented and the fluidity of the toner is improved.

For the volume average particle diameter of the silica particles, 100 primary particles of the silica particles after dispersing the silica particles in the toner particle, are observed using a scanning electron microscope (SEM: S-4800 manufactured by Hitachi High-Technologies Corporation), the maximum diameter and the minimum diameter for each particle are measured by the image analysis of the primary particles, and an equivalent spherical diameter is measured from a median value thereof. A diameter with the cumulative frequency of 50% of the obtained equivalent spherical diameter (D50v) is set as the volume average particle diameter of the silica particles. The measurement of the volume average particle diameter of the titania particles which will be described later is also performed in the same manner.

A coverage of the silica particles with respect to the toner particle is from 50% to 100%, more preferably from 60% to 80%, and even more preferably from 65% to 80%. When the coverage thereof is equal to or more than 50%, the fluidity of the toner is easily obtained. Meanwhile, when the coverage thereof is equal to or less than 100%, it is easy to prevent the toner from remaining on the photoreceptor (an example of image holding member).

The coverage of the silica particles with respect to the toner particle is a value measured by the following method. Mapping is performed at an accelerating voltage of 20 kV using an energy dispersion type X-ray analysis device (EMAX model 6923H (manufactured by Horiba, Ltd.)) attached to a scanning electron microscope (SEM: S-4800 manufactured by Hitachi High-Technologies Corporation). Then, 1,000 portions of circular particles (average value of the long diameter and the short diameter: acquired to be similar to circle) corresponding to an image area of the toner particles (from 300 nm to 1,000 nm) are measured, and a Si ratio with respect to the entire element configuring the toner particle is calculated. This Si ratio is set as the coverage of the silica particles. The measurement of the coverage of the titania particles which will be described later with respect to the toner particle is also performed in the same manner.

The silica particles are not particularly limited, but fumed silica, colloidal silica, or sol-gel silica is used, and fumed silica is preferably used. These silica particles may be used alone or in combination of two or more kinds thereof.

Other Particles

As other particles, the titania particles are preferable. A volume average particle diameter of the titania particles is preferably from 8 nm to 50 nm and more preferably from 10 nm to 40 nm. When the volume average particle diameter is from 8 nm to 50 nm, dispersibility of the titania particles is improved.

A coverage of the titania particles with respect to the toner particle is preferably from 10% to 50% and more preferably from 20% to 50%. When the coverage thereof is equal to or more than 10%, charging properties are easily maintained. Meanwhile, when the coverage thereof is equal to or less than 50%, a decrease in image density is easily prevented.

Examples of the titania particles include anatase-type titania, rutile-type titania, and metatitanic acid. Among these, metatitanic acid is preferable, in order to maintain the charging properties of the toner.

Examples of particles other than the titania particles include $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The preparing method of the titania particles is not particularly limited, and for example, a wet precipitation method of dissolving ilmenite as an ore in sulfuric acid to separate iron powder, and performing hydrolysis of $TiOSO_4$ to form $TiO(OH)_2$, is used.

The surface of the inorganic particles (silica particles and titania particles) as the external additives is preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of other particles also include resin particles (resin particles such as polystyrene, PMMA (polymethylmethacrylate), and melamine resin particles) and a cleaning aid (e.g., metal salt of a higher fatty acid represented by zinc stearate, and fluorine-based polymer particles), in addition to the inorganic particles.

The amount of the external additives externally added is, for example, preferably from 0.01% by weight to 5% by weight, and more preferably from 0.01% by weight to 2.0% by weight with respect to the toner particles.

Preparing Method of Toner

Next, a method of preparing a toner according to the exemplary embodiment will be described.

The toner according to the exemplary embodiment is obtained by externally adding an external additive to toner particles after preparing of the toner particles.

The toner particles may be prepared using any of a dry method (e.g., kneading and pulverizing method) and a wet method (e.g., aggregation and coalescence method, suspension and polymerization method, and dissolution and suspension method). The toner particle preparing method is not particularly limited to these methods, and a known method is employed.

Among these, the toner particles are preferably obtained by an aggregation and coalescence method.

Specifically, for example, when the toner particles (toner particles having a core/shell structure) are prepared by an aggregation and coalescence method, the toner particles are preferably prepared through the processes of: preparing a first resin particle dispersion in which first resin particles (first resin particles for a binder resin configuring the core (core particles) of toner particle) are dispersed, aggregating the first resin particles, and forming first aggregated particles (first aggregation process); mixing the first aggregated particle dispersion in which the first aggregated particles are dispersed, a second resin particle dispersion in which second resin particles (second resin particles for a binder resin configuring the shell layer of the toner particle) are dispersed, and a crosslinked resin particle dispersion in which crosslinked resin particles (crosslinked resin particle contained in the shell layer of the toner particle) are dispersed, with each other, aggregating the particles so as to adhere the second resin particles and the crosslinked resin particles to the surface of the first aggregated particles, and forming second aggregated particles (second aggregation process); and heating the second aggregated particle dispersion in which the second aggregated particles are dispersed, to coalesce the second aggregated particles, thereby forming toner particles (coalescence process).

The same resin particles may be used for the first resin particles and the second resin particles.

Hereinafter, the respective processes will be described in detail.

In the following description, a method of obtaining the toner particles containing the colorant and the release agent will be described, but the colorant and the release agent are only used, if necessary. Additives other than the colorant and the release agent may be used.

First Aggregated Particle Forming Process

First, with the first resin particle dispersion in which the first resin particles are dispersed, a colorant particle dispersion in which colorant particles are dispersed and a release agent particle dispersion in which release agent particles are dispersed, are prepared, for example.

The first resin particles dispersed in the first resin particle dispersion are resin particles for a binder resin configuring the core of the toner particle.

For the first resin particle dispersion, when using two or more kinds of first resin particles, each first resin particle dispersion may be prepared and mixed to each other to prepare one resin particle dispersion, or each first resin particle dispersion may be mixed with each other when mixing the colorant particle dispersion and the release agent particle dispersion.

The first resin particle dispersion is prepared by, for example, dispersing the first particles by a surfactant in a dispersion medium.

Examples of the dispersion medium used for the first resin particle dispersion include aqueous mediums. Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap-based anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the first resin particle dispersion, as a method of dispersing the first resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; performing neutralization by adding a base to an organic continuous phase (O phase); and converting the resin (so-called phase inversion) from W/O to O/W by adding an aqueous medium (W phase) to form a discontinuous phase, thereby dispersing the resin as particles in the aqueous medium.

The volume average particle diameter of the first resin particles dispersed in the first resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700, manufactured by Horiba, Ltd.), and a particle diameter when the cumulative percentage becomes 50% with respect to the entirety of the particles is measured as a volume average particle diameter D50v. The volume average particle diameter of the particles in other dispersions is also measured in the same manner.

The content of the first resin particles contained in the first resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the first resin particle dispersion. That is, the particles in the first resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

This is same for the second resin particles.

Next, the colorant particle dispersion and the release agent dispersion are mixed together with the first resin particle dispersion.

The first resin particles, the colorant particles, and the release agent particles heterogeneously aggregate in the mixed dispersion, thereby forming first aggregated particles (core aggregated particles) having a diameter near a target toner particle diameter and including the first resin particles, the colorant particles, and the release agent particles.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature of the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the mixed dispersion, thereby forming the first aggregated particles.

In the first aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

Examples of the aggregating agent include a surfactant having an opposite polarity to the polarity of the surfactant used as the dispersing agent added to the mixed dispersion, inorganic metal salts and di- or higher-valent metal complexes. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Second Aggregated Particle Forming Process

Next, the first aggregated particle dispersion in which the first aggregated particles are dispersed, the second resin particle dispersion in which the second resin particles (second resin particles for a binder resin configuring the shell layer of the toner particle) are dispersed, and the crosslinked resin particle dispersion in which the crosslinked resin particles (crosslinked resin particle contained in the shell layer of the toner particle) are dispersed, are mixed with each other. The second resin particle dispersion and the crosslinked resin particle dispersion may be mixed with each other in advance, and this mixture may be mixed with the first aggregated particle dispersion.

In this mixed dispersion, the particles are aggregated so as to adhere the second resin particles and the crosslinked resin particles to the surface of the first aggregated particles, and the second aggregated particles in which the second resin particles and the crosslinked resin particles are adhered to the surface of the first aggregated particles are formed.

Specifically, for example, in the first aggregated particle forming process, when the desired particle diameter (for example, volume average particle diameter equal to or greater than 1.5 μm and preferably of 2.5 μm to 6.5 μm) of the first aggregated particles is achieved, the second resin particle dispersion and the crosslinked resin particle dispersion are mixed with the first aggregated particle dispersion, and this mixed dispersion is heated at a temperature equal to or lower than the lower glass transition temperature among the glass transition temperatures of the first aggregated particles, the second resin particles, and the crosslinked resin particles.

By setting the pH of the mixed dispersion in a range of 6.5 to 8.5, for example, the progress of the aggregation is stopped.

Herein, the volume average particle diameter of the second resin particles dispersed in the second resin particle dispersion is, for example, preferably from 0.01 μm to 1 μm, more preferably from 0.08 μm to 0.8 μm, and even more preferably from 0.1 μm to 0.6 μm.

By performing the second aggregated particle forming process, the second aggregated particles which are aggregated so as to adhere the second resin particles and the crosslinked resin particles to the surface of the first aggregated particles are obtained.

Coalescence Process

Next, the second aggregated particle dispersion in which the second aggregated particles are dispersed is heated at, for example, a temperature that is equal to or higher than the glass transition temperature of the second resin particles (for example, a temperature that is higher than the glass transition temperature of the second resin particles by 10° C. to 30° C.) to coalesce the second aggregated particles and form toner particles.

By performing the above processes, the toner particle (toner particle having a core/shell structure) which is configured with the core and the shell layer (surface layer portion) covering the core and in which the crosslinked resin particles are contained in the surface layer portion, is obtained.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the exemplary embodiment is prepared by, for example, adding and mixing an external additive with dry toner particles that have been obtained. The mixing is preferably performed with, for example, a V-blender, a HENSCHEL mixer, a LÖDIGE mixer, or the like. Furthermore, if necessary, coarse toner particles may be removed using a vibration sieving machine, a wind classifier, or the like.

Electrostatic Charge Image Developer

An electrostatic charge image developer according to the exemplary embodiment (hereinafter, referred to as a "developer" in some cases) includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic particle are coated with a coating resin; a magnetic particle dispersion-type carrier in which magnetic particles are dispersed in and blended into a matrix resin; and a resin impregnation-type carrier in which a porous magnetic particle is impregnated with a resin.

The magnetic particle dispersion-type carrier and the resin impregnation-type carrier may be carriers in which constituent particles of the carrier are cores and have a surface coated with a coating resin.

Examples of the magnetic particle include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain additives such as a conductive material.

Herein, a coating method using a coating layer forming solution in which a coating resin and, if necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution onto surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with an electrostatic charge image developer to form a toner image, a transfer unit that transfers the toner image formed on the surface of the image holding member onto a surface of a recording medium, a fixing unit that fixes the toner image transferred onto the surface of the recording medium, a cleaning unit that removes toner remaining on the surface of the image holding member, and a toner supply unit which supplies the removed toner to the developing unit. As the electrostatic charge image developer, the electrostatic charge image developer according to the exemplary embodiment is applied.

In the image forming apparatus according to the exemplary embodiment, an image forming method (image forming method according to the exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer to form a toner image, a transfer process of transferring the toner image formed on the surface of the image holding member onto a surface of a recording medium, a fixing process of fixing the toner image transferred onto the surface of the recording medium, a cleaning process of removing toner remaining on the surface of the image holding member, and a toner supply process of supplying the removed toner to the developing unit, is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; or an apparatus that is provided with an erasing device that irradiates, after transfer of a toner image and before charging, a surface of an image holding member with erasing light for erasing.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that is provided with a developing unit containing the electrostatic charge image developer according to the exemplary embodiment is preferably used.

Hereinafter, an example of the image forming apparatus according to the exemplary embodiment will be described. However, the image forming apparatus is not limited thereto. The major parts shown in the drawing will be described, but descriptions of other parts will be omitted.

Figure 1:
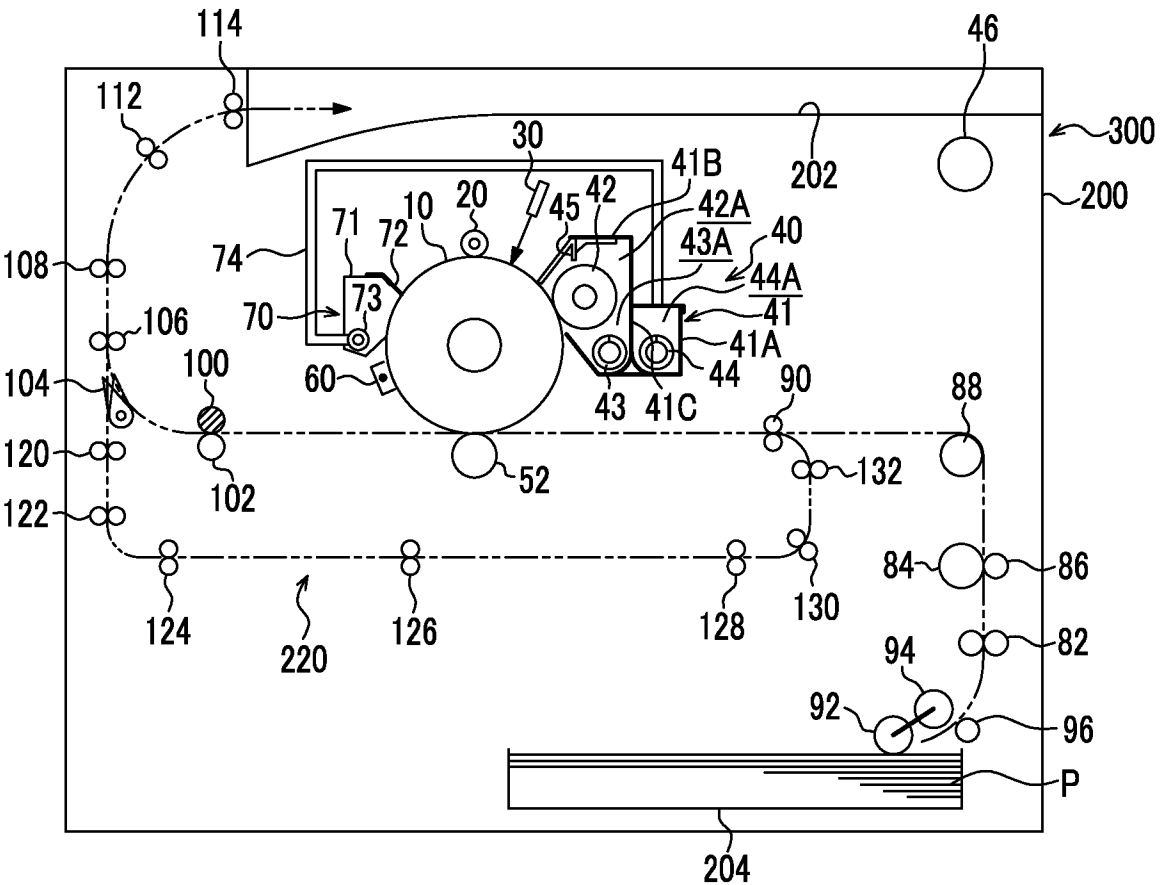
FIG. 1 is a schematic configuration diagram showing an example of an image forming apparatus according to the exemplary embodiment.

FIG. 1 is a schematic configuration diagram showing the image forming apparatus according to the exemplary embodiment.

An image forming apparatus 300 shown in FIG. 1, for example, includes a rectangular housing 200, a paper tray 204 in which recording sheets (an example of the recording medium) P are stacked is mounted on the lower side of the housing 200, and a drawing roller 92 which is included at one end side of an arm to be rotated, corresponding to the mounted position of the paper tray 204. A roller 94 disposed coaxially with the rotation center of the arm and a roller 96 disposed corresponding to the roller are provided on the other end side of the arm.

When performing the image forming, the drawing roller 92 is moved downwards, the drawing roller 92 is rotated in a state of being in contact with the uppermost recording sheet P, and the drawing of the recording sheet P is performed. The drawn recording sheet P is guided by the rollers 94 and 96, and is interposed between a roller pair 82 disposed on the downstream side of the roller 96 in a sheet feeding direction, and fed. A roller 84 and a roller 86 disposed to oppose each other, and a roller 88 which changes the feeding direction of the recording sheet P by 90°, and a pair of rollers 90 is arranged in this order, on the downstream side of the roller pair 82 in the feeding direction.

The image forming apparatus 300 includes a photoreceptor 10 as a cylindrical image holding member at the upper side in the housing 200.

The photoreceptor 10 is rotated clockwise. A charging roller 20 (an example of the charging unit) that is provided to oppose the photoreceptor 10 and negatively charges the surface of the photoreceptor 10, an exposure device 30 (an example of the electrostatic charge image forming unit) that forms an electrostatic charge image like an image to be formed by a toner (developer) on the surface of the photoreceptor 10 charged by the charging roller 20, a developing device 40 (an example of the developing unit) that adheres the toner to the electrostatic charge image formed by the exposure device 30 to form a toner image on the surface of the photoreceptor 10, a transfer roller 52 which is provided to oppose the photoreceptor 10 and transfers the toner image to the recording sheet P, an erasing device 60 which erases the surface of the photoreceptor 10 after the toner image is transferred to the transfer roller 52, if necessary, to easily remove the toner remaining on the surface, a cleaning device 70 (an example of the cleaning unit) that cleans the surface of the photoreceptor 10 and removes the remaining toner, and a supply transportation path 74 (an example of the toner supply unit) that supplies the removed toner (collected toner) to the developing device 40 are included over the photoreceptor 10.

The charging roller 20, the exposure device 30, the developing device 40, the transfer roller 52, the erasing device 60, and the cleaning device 70 are disposed clockwise in this order over the photoreceptor 10.

As described above, the surface of the photoreceptor 10 is negatively charged by the charging roller 20, and the electrostatic charge image like an image to be formed with the toner (developer) is formed on the surface of the charged photoreceptor 10 by the exposure device 30.

Hereinafter, the developing device 40 will be described in detail. The developing device 40 is disposed to oppose the photoreceptor 10 in a developing area, and includes a developing container 41 which accommodates a two-component developer formed of a toner charged to a negative (−) polarity and a carrier charged to a positive (+) polarity, for example. The developing container 41 includes a developing container main body 41A and a developing container cover 41B covering the upper end thereof.

The developing container main body 41A includes a developing roller chamber 42A that accommodates a developing roller 42 therein, is disposed to be adjacent to the developing roller chamber 42A, and includes a first stirring chamber 43A and a second stirring chamber 44A adjacent to the first stirring chamber 43A. A layer thickness regulation member 45 for regulating a layer thickness of the developer on the surface of the developing roller 42, when the developing container cover 41B is mounted on the developing container main body 41A, is provided in the developing roller chamber 42A.

The first stirring chamber 43A and the second stirring chamber 44A are partitioned by a partition wall 41C. Although not shown, the first stirring chamber 43A and the second stirring chamber 44A are connected to each other by providing openings on both end portions of the partition wall 41C in the longitudinal direction (developing device longitudinal direction), and a circulating stirring chamber (43A+ 44A) is configured by the first stirring chamber 43A and the second stirring chamber 44A.

The developing roller 42 is disposed in the developing roller chamber 42A so as to oppose the photoreceptor 10. Although not shown, the developing roller 42 is obtained by providing a sleeve at the outer side of a magnetic roller (stationary magnet) having a magnetic property. The developer of the first stirring chamber 43A is adsorbed onto the surface of the developing roller 42 by the magnetic force of the magnetic roller and is transported to the developing area. A roller axis of the developing roller 42 is rotatably supported by the developer container main body 41A. Herein, the developing roller 42 and the photoreceptor 10 rotate in the same direction, and the developer adsorbed onto the surface of the developing roller 42 in the facing portion is transported to the developing area in a direction opposite to the travelling direction of the photoreceptor 10.

In addition, a bias supply (not shown) is connected to the sleeve of the developing roller 42, and a developing bias is applied (in the exemplary embodiment, applying bias in which an alternating-current component (AC) is superimposed on a direct current component (DC) so that an alternating electric field is applied to the developing area).

A first stirring member 43 (stirring and transporting member) and a second stirring member 44 (stirring and transporting member) which transports the developer while stirring the developer, are respectively disposed in the first stirring chamber 43A and the second stirring chamber 44A. The first stirring member 43 is configured with a first rotation shaft which extends in an axial direction of the developing roller 42, and a stirring transporting blade (protrusion) fixed on the outer periphery of the rotation shaft in a spiral shape. The second stirring member 44 is also configured with a second rotation shaft and a stirring transporting blade (protrusion) in the same manner. The stirring member is rotatably supported by the developing container main body 41A. The first stirring member 43 and the second stirring member 44 are disposed so that the developers in the first stirring chamber 43A and the second stirring chamber 44A are transported in opposite directions by the rotation thereof.

Next, the cleaning device 70 will be described in detail. The cleaning device 70 is configured to include a housing 71, and a cleaning blade 72 disposed to protrude from the housing 71. The cleaning blade 72 has a plate shape which extends to the rotation shaft of the photoreceptor 10 and is provided so that a tip portion (hereinafter, referred to as an edge portion) is subjected to press-contact with the downstream side of the transfer position by the transfer roller 52 on the photoreceptor 10 in the rotation direction (clockwise direction) and on the downstream side of the position erased by the erasing device 60 in the rotation direction.

Since the photoreceptor 10 rotates clockwise, the cleaning blade 72 blocks foreign materials such as toner remaining on the photoreceptor 10 without being transferred to the recording sheet P or paper powder of the recording sheet P and removes the foreign materials from the photoreceptor 10.

Herein, as the material of the cleaning blade 72, a well-known material may be used, and urethane rubber, silicon rubber, fluororubber, chloroprene rubber, or butadiene rubber may be used, for example. Among these, polyurethane is particularly preferably used, from a viewpoint of excellent abrasion resistance.

A transporting member 73 is disposed on the bottom portion of the housing 71, and one end of the supply transportation path 74 for supplying the toner (developer) removed by the cleaning blade 72 to the developing device 40 is connected to the downstream side in the transporting direction of the transporting member 73 in the housing 71. The other end of the supply transportation path 74 is connected to the developing device 40 (second stirring chamber 44A).

The cleaning device 70 supplies the toner (developer) removed by the cleaning blade 72 to the developing device 40 (second stirring chamber 44A) through the supply transportation path 74, according to the rotation of the transporting member 73 provided on the bottom portion of the housing 71. The collected toner supplied to the second stirring chamber 44A is stirred with the toner (developer) accommodated in the second stirring chamber 44A and is reused. As described above, the image forming apparatus 300 of the exemplary embodiment employs the toner reclaiming method of reusing the collected toner. In addition, the toner accommodated in a toner cartridge 46 is also supplied to the developing device 40 through a toner supply tube (not shown).

The recording sheet P transported to the disposed portion of the transfer roller 52 which is provided to oppose the photoreceptor 10 is pressed against the photoreceptor 10 by the transfer roller 52, and a toner image formed on the outer periphery surface of the photoreceptor 10 is transferred. A fixing device (an example of the fixing unit) including a fixing roller 100 and a roller 102 which are disposed to oppose each other, and a cam 104 are provided in this order at the downstream side of the transfer roller 52 in the sheet feeding direction. The recording sheet P to which the toner image is transferred is interposed between the fixing roller 100 and the roller 102, and the toner image is fixed thereto, and the recording sheet reaches the disposed portion of the cam 104. The cam 104 is rotatably driven by a motor (not shown), and is fixed to a position shown with a solid line or a position shown with a virtual line in FIG. 1.

When the recording sheet P reaches from the fixing roller 100 side, the cam 104 is rotatably driven to the opposite side of the fixing roller 100 (position shown with a solid line). Accordingly, the recording sheet P reaching from the fixing roller 100 side is introduced to a roller pair 106 along the outer periphery surface of the cam 104. Roller pairs 106, 108, 112, and 114 are disposed in this order at the downstream side of the cam 104 in an introducing direction of the recording sheet P in this case, and a sheet receiver 202 is disposed on the downstream side of the roller pair 114 in the sheet feeding direction.

Accordingly, the recording sheet P reaching from the fixing roller 100 side is interposed between the roller pairs 106 and 108, and when the roller pairs 106 and 108 are continuously rotated, the recording sheet P is transported to the sheet receiver 202.

When a surface of the recording sheet P where the image is recorded, which is temporarily interposed between the roller pairs 106 and 108 is inverted to a back surface of the surface where the image is recorded, the cam 104 is rotatably driven to the fixing roller 100 side (position shown with a virtual line). When the rotation direction of the roller pairs 106 and 108 is inverted in this state, the feeding direction of the recording sheet P is inverted by an inversion transporting (hereinafter, referred to as "switch-back") method, and when the recording sheet P is transported from the roller pairs 106 and 108 side to the cam 104, the recording sheet P is introduced downwards along the outer periphery surface of the cam 104. In this case, a roller pair 120 is disposed at the downstream side of the cam 104 in the feeding direction of the recording sheet P, and the recording sheet P reaching the disposed portion of the roller pair 120 is further transported by applying a transportation force by the roller pair 120.

FIG. 1 shows a transporting path of the recording sheet P with a virtual line.

Roller pairs 122, 124, 126, 128, 130, and 132 are disposed in this order at the downstream side of the roller pair 120 in the feeding direction of the recording sheet P along the transporting path of the recording sheet P shown with a virtual line in FIG. 1, and the roller pairs configure a recording sheet inverting unit 220 with the cam 104 and the roller pairs 106, 108, and 120 described above. The recording sheet P switched-back in the disposed portions of the roller pairs 106 and 108 is transported along the transporting path shown with a virtual line in FIG. 1, reaches the disposed portion of the roller pair 90, and is transported to a nip portion between the photoreceptor 10 and the transfer roller 52, again.

At that time, as described above, the recording sheet P is switched-back in the recording sheet inverting unit 220. Accordingly, when the back surface of the surface where the image is previously recorded is inverted so that the back surface faces the photoreceptor 10 side, and the toner image is transferred to this back surface and is fixed thereto by the fixing roller 100, the image is recorded on both sides. The recording sheet P having the image recorded on both surfaces thereof is discharged to the sheet receiver 202 so that the surface where the image is recorded later is at the back side. When the image is not recorded on the recording sheet P in the later image recording (image recording after the recording sheet P is inverted in the recording sheet inverting unit), the recording sheet P is discharged to the sheet receiver 202 so that the surface where the image is previously recorded is at the front side.

Examples of the recording sheet P onto which a toner image is transferred include plain paper that is used in electrophotographic copying machines, printers, and the like. As a recording medium, an OHP sheet is also exemplified other than the recording sheet P. For example, coating paper obtained by coating a surface of plain paper with a resin or the like, art paper for printing, and the like are preferably used.

Process Cartridge/Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be illustrated. However, the process cartridge is not limited thereto. Major parts shown in the drawing will be described, and descriptions of other parts will be omitted.

Figure 2:
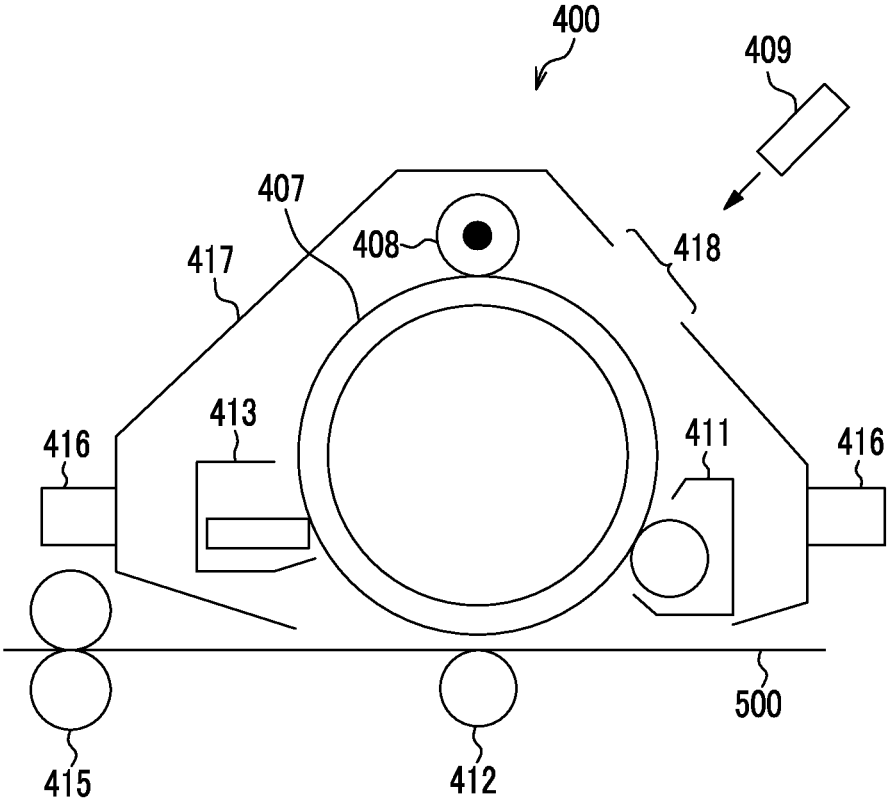
FIG. 2 is a schematic configuration diagram showing an example of a process cartridge according to the exemplary embodiment.

FIG. 2 is a schematic diagram showing a configuration of the process cartridge according to the exemplary embodiment.

A process cartridge 400 shown in FIG. 2 is formed as a cartridge having a configuration in which a photoreceptor 407 (an example of the image holding member), and a charging roller 408 (an example of the charging unit), a developing device 411 (an example of the developing unit), and a photoreceptor cleaning device 413 (an example of the cleaning unit), which are provided around the photoreceptor 407, are integrally combined and held by the use of, for example, a housing 417 provided with a mounting rail 416 and an opening 418 for exposure.

In FIG. 2, the reference numeral 409 represents an exposure device (an example of the electrostatic charge image forming unit), the reference numeral 412 represents a transfer device (an example of the transfer unit), the reference numeral 415 represents a fixing device (an example of the fixing unit), and the reference numeral 500 represents a recording sheet (an example of the recording medium). In FIG. 2, a mechanism of toner reclaiming of supplying the toner removed by the photoreceptor cleaning device 413 to the developing device 411 through the supply transportation path (an example of the toner supply unit) and reusing the toner, for example, is omitted.

Next, a toner cartridge according to the exemplary embodiment will be described.

The toner cartridge according to the exemplary embodiment includes a container that accommodates the toner according to the exemplary embodiment and is detachable from an image forming apparatus. The toner cartridge accommodates a toner for replenishment to be supplied to the developing unit provided in the image forming apparatus.

The image forming apparatus shown in FIG. 1 has such a configuration that the toner cartridge 46 is detachable therefrom, and the developing device 40 is connected to the toner cartridge 46 via a toner supply tube (not shown). In addition, when the toner accommodated in the toner cartridge runs low, the toner cartridge is replaced.

EXAMPLES

Hereinafter, the invention will be described in detail with reference to examples. However, the invention is not limited by the examples. In the description, unless otherwise noted, "parts" means "parts by weight" and "%" means "% by weight".

Synthesis of Polyester Resin (1)

2 mol adduct of ethylene oxide of bisphenol A: 114 parts
2 mol adduct of propylene oxide of bisphenol A: 84 parts
Dimethyl terephthalate ester: 75 parts
Dodecenyl succinic acid: 19.5 parts
Trimellitic acid: 7.5 parts The above components are added into a flask including a stirrer, a nitrogen gas introducing tube, a temperature sensor, and a rectifier, and are heated to a temperature of 190° C. over 1 hour, and after stirring the inside of the reaction system, 3.0 parts of dibutyl tin oxide is added thereto. In addition, the temperature is increased from 190° C. to 240° C. over 6 hours while distilling away the generated water, and a dehydration condensation reaction is further continued at 240° C. for 2 hours, and a polyester resin (1) is synthesized.

Regarding the obtained polyester resin (1), a glass transition temperature (Tg) is 54° C., an acid value is 15.3 mgKOH/g, a weight average molecular weight is 58,000, and a number average molecular weight is 5,600.

Preparation of Polyester Resin Dispersion (1)

Polyester resin (1) (Mw: 58,000): 136 parts

Dimethylacrylamide (manufactured by Kohjin co., Ltd., molecular weight of 99): 16 parts 1-hydroxy-cyclohexyl phenyl ketone (product name: IRGACURE 184 manufactured by BASF): 8 parts Ethyl acetate: 233 parts Sodium hydroxide aqueous solution (0.3 N): 0.1 parts The above components are put in a separable flask, heated at 70° C., and stirred with a THREE-ONE MOTOR (manufactured by Shinto Scientific Co., Ltd.) to prepare a resin mixed liquid. The resin mixed liquid is cooled to 25° C. while being further stirred, 160 parts of the ion exchange water is slowly added therein to perform phase inversion emulsification, and the solvent thereof is removed to obtain polyester resin particle dispersion (1) (solid content concentration: 46%). A volume average particle diameter of the resin particles in the dispersion is 165 nm.

Preparation of Crosslinked Resin Particle Dispersion

Preparation of Crosslinked Resin Particle Dispersion (1)

Styrene: 79 parts n-butyl acrylate: 5.2 parts

Dimethylaminoethyl acrylate: 15.8 parts

Acrylic acid: 1.8 parts

Dodecanethiol: 2.0 parts

Divinyl adipate: 1.0 part (all manufactured by Wako Pure Chemical Industries, Ltd.)

A mixture obtained by mixing and dissolving the above components is added to a solution obtained by dissolving 1.5 parts of a nonionic surfactant (NONIPOL 400 manufactured by Sanyo Chemical Industries, Ltd.) and 2 parts of an anionic surfactant (NEOGEN SC manufactured by Dai-Ichi Kogyo Seiyaku Co., Ltd.) in 150 parts of ion exchange water, and is dispersed and emulsified in a flask, and gently mixed for 10 minutes, and 28.2 parts of ion exchange water in which 5 parts of sodium persulfate (Wako Pure Chemical Industries, Ltd.) is dissolved is put therein. Nitrogen substitution is performed at 0.1 liter/min. for 20 minutes. After that, the resultant material is heated in an oil bath to 70° C. while stirring it in the flask, and emulsification and polymerization is continued for 5 hours. Accordingly, crosslinked resin particle dispersion (1) having a volume average particle diameter D50v of 150 nm and solid content concentration of 40% is prepared. When the differential scanning calorimetry (DSC) of the crosslinked resin particles obtained by keeping some of the dispersion on an oven at 100° C. and removing the moisture thereof, is performed, a glass transition temperature is 65° C. and a weight average molecular weight is 42,000. A ratio (Mw/Mn) of the weight average molecular weight Mw and the number average molecular weight Mn of the crosslinked resin particle in this case is 7.5.

Preparation of Crosslinked Resin Particle Dispersion (2)

Styrene: 74 parts n-butyl acrylate: 6.3 parts

Dimethylaminoethyl acrylate: 15.8 parts

Acrylic acid: 2.6 parts

Dodecanethiol: 2.7 parts

Divinyl adipate: 1.0 part (all manufactured by Wako Pure Chemical Industries, Ltd.)

Crosslinked resin particle dispersion (2) having a volume average particle diameter D50v of 60 nm and solid content concentration of 46% is obtained by performing the process in the same manner as in the case of the crosslinked resin particle dispersion (1) except for mixing the above components. When the differential scanning calorimetry (DSC) of the crosslinked resin particles obtained by keeping some of the dispersion on an oven at 100° C. and removing the moisture thereof, is performed, a glass transition temperature is 56° C. and a weight average molecular weight is 39,000. A ratio (Mw/Mn) of the weight average molecular weight Mw and the number average molecular weight Mn of the crosslinked resin particle in this case is 7.8.

Preparation of Silica Particles

Preparation of Silica Particles (1)

A hexamethyldisilazane (HMDS) treatment is performed for the silica particles obtained by the Aerosil method, followed by drying, and pulverizing, and silica particles (1) having a volume average particle diameter of 120 nm and a BET specific surface area of 25 $m^2/g$, and a specific gravity of 2.3 are obtained.

The specific surface area is a specific surface area value of nitrogen obtained by a BET method, and is measured using a specific surface area measuring machine of BET method (FLOWSORB II 2300 manufactured by Shimadzu Corporation).

Preparation of Silica Particles (2)

Based on the preparation of the silica particles (1), silica particles (2) having a volume average particle diameter of 40 nm, a BET specific surface area of 22 $m^2/g$, and a specific gravity of 2.3, silica particles (3) having a volume average particle diameter of 280 nm, a BET specific surface area of 23 $m^2/g$, and a specific gravity of 2.3, silica particles (4) having a volume average particle diameter of 350 nm, a BET specific surface area of 19 $m^2/g$, and a specific gravity of 2.3, and silica particles (5) having a volume average particle diameter of 20 nm, a BET specific surface area of 51 $m^2/g$, and a specific gravity of 2.4 are obtained.

Preparation of Titania Particles (1)

$TiO(OH)_2$ is prepared using a wet precipitation method of dissolving ilmenite as an ore in sulfuric acid to separate iron powder, and performing hydrolysis of $TiOSO_4$ to form $TiO(OH)_2$. In the process of preparing the $TiO(OH)_2$, dispersion adjustment and water washing for nucleation are performed with the hydrolysis. 100 parts of the obtained $TiO(OH)_2$ is dispersed in 1,000 ml of water, and 40 parts of isobutyl trimethoxysilane is added dropwise thereto while stirring at a room temperature (25° C.). Then, filtration and water washing of this are repeated. The obtained "metatitanic acid particles subjected to a surface hydrophobization treatment with the isobutyl trimethoxysilane" are dried at 150° C., and hydrophobic titania particles (1) having a volume average particle diameter of 40 nm, a BET specific surface area of 120 $m^2/g$, and a specific gravity of 4.2 are prepared.

Preparation of Release Agent Dispersion

Polyethylene wax (POLYWAX 725 manufactured by Toyo Adl Corporation, melting point: 100° C.): 50 parts Anionic surfactant (NEOGEN RK manufactured by Dai-Ichi Kogyo Seiyaku Co., Ltd.): 0.5 parts Ion exchange water: 200 parts The above components are mixed with each other, heated to 95° C., and dispersed using a homogenizer (ULTRA TURRAX T50 manufactured by IKA Japan, K.K.). After that, the mixture is subject to dispersion treatment with MANTON-GAULIN high pressure homogenizer (manufactured by Gaulin Co., Ltd.), and a release agent dispersion (solid content concentration: 20%) formed by dispersing the release agent is prepared. A volume average particle diameter of the release agent is 0.23 μm.

Preparation of Colorant Dispersion

Cyan pigment (Pigment Blue 15:3 (copper phthalocyanine) manufactured by Dainichiseika Color & Chemicals Mfg. Co. Ltd.): 1,000 parts Anionic surfactant: (NEOGEN R manufactured by Dai-Ichi Kogyo Seiyaku Co., Ltd.): 15 parts Ion exchange water: 9,000 parts The above components are mixed, dissolved, and dispersed using a high-pressure impact type disperser ULTIMIZER (HJP30006 manufactured by SUGINO MACHINE LIMITED) for 1 hour, and a colorant dispersion in which a colorant (cyan pigment) is dispersed is prepared. A volume average particle diameter of the colorant (cyan pigment) of the colorant dispersion is 0.16 μm and solid content concentration thereof is 20%.

Example 1

Preparation of Toner Particles

Ion exchange water: 290 parts

Polyester resin dispersion (1): 115 parts

Colorant dispersion: 25 parts

Release agent dispersion: 50 parts

Anionic surfactant (NEOGEN RK manufactured by Dai-Ichi Kogyo Seiyaku Co., Ltd., 20% by weight): 2.8 parts The above components are added into a reaction vessel including a thermometer, a pH meter, and a stirrer, and kept for 30 minutes at a temperature of 30° C. and a stirring rotation rate of 150 rpm, while controlling the temperature by a mantle heater outside. After that, 0.3 N aqueous solution of nitric acid is added thereto, and pH in the first aggregated particle forming process is adjusted to 3.0.

A PAC aqueous solution obtained by dissolving 0.7 parts of polyaluminum chloride (PAC manufactured by Asada Chemical INDUSTRY Co., Ltd.: #100) in 7 parts of ion exchange water is added while dispersing using a homogenizer (ULTRA TURRAX T50 manufactured by IKA Japan, K.K.). After that, the temperature is increased to 50° C. while stirring, and the first aggregated particles having a volume average particle diameter of 5.0 μm are formed. The volume average particle diameter of the first aggregated particles is measured using a COULTER MULTISIZER II (manufactured by Coulter, Inc., aperture diameter: 50 μm).

After that, the dispersion obtained by mixing the following components are added thereto, the crosslinked resin particles are adhered (shell structure) to the surface of the first aggregated particles, and the second aggregated particles are formed.

Polyester resin dispersion (1): 62 parts

Crosslinked resin particle dispersion (1): 30 parts

Then, 20 parts of 10 weight % nitrilotriacetic acid (NTA) metal salt aqueous solution (CHELEST 70 manufactured by Chelest Corporation) is added, and pH is adjusted to 9.0 using 1 N sodium hydroxide aqueous solution. After that, the mixture is heated to 75° C. by setting a temperature rising rate of 1.0° C./min, maintained at 75° C. for 3 hours, cooled, and filtrated, and coarse toner particles are obtained. Dispersion again using ion exchange water and filtration are repeated, and washing is performed until electric conductivity of the filtrated solution is equal to or less than 20 μS/cm, and then, vacuum drying is performed in an oven at 40° C. for 5 hours, and toner particles in which the second aggregated particles are coalesced are obtained.

The image analysis of the image of the cross section of the obtained toner particle is performed using a scanning electron microscope (SEM: S-4800 manufactured by Hitachi High-Technologies Corporation), and accordingly, the volume average particle diameter of the crosslinked resin particles included in the surface layer portion, and the area ratio of the crosslinked resin particles and the area excluding the area of the crosslinked resin particles (crosslinked resin particles/area excluding the area of the crosslinked resin particles) are measured. In addition, the presence or absence of the crosslinked resin particles in the surface layer portion is checked. The results are shown in Tables 1 and 2.

Preparation of Toner (1)

1.5 parts of the silica particles (1) and 1.0 part of the titania particles (1) are mixed with respect to 100 parts of the toner particles using a sample mill at 10,000 rpm for 30 seconds. After that, the mixture is sieved by a vibration sieving device having an aperture of 45 μm, and a toner (1) is prepared. A volume average particle diameter of the obtained toner (1) is 6.5 μm.

Example 2

A toner (2) is prepared in the same manner as in Example 1, except for changing the crosslinked resin particle dispersion (1) to the crosslinked resin particle dispersion (2) and the amount added thereof to 15 parts, and changing the silica particles (1) to the silica particles (2) and the amount added thereof to 0.5 parts.

Example 3

A toner (3) is prepared in the same manner as in Example 1, except for changing the crosslinked resin particle dispersion (1) to the crosslinked resin particle dispersion (2) and the amount added thereof to 15 parts, and changing the silica particles (1) to the silica particles (3) and the amount added thereof to 1.5 parts.

Example 4

A toner (4) is prepared in the same manner as in Example 1, except for changing the amount of the crosslinked resin particle dispersion (1) added to 6.0 parts.

Example 5

A toner (5) is prepared in the same manner as in Example 1, except for not adding the titania particles (1).

Example 6

A toner (6) is prepared in the same manner as in Example 1, except for changing the amount of the silica particles (1) added to 2.0 parts and the amount of the titania particles (1) added to 0.4 parts.

Comparative Example 1

A toner (7) is prepared in the same manner as in Example 1, except for only adding the polyester resin dispersion (1)

without adding the dispersion obtained by mixing the polyester resin dispersion (1) and the crosslinked resin particle dispersion (1).

Comparative Example 2

A toner (8) is prepared in the same manner as in Comparative Example 1, except that the first aggregated particles are formed by mixing the crosslinked resin particle dispersion (1) to the polyester resin dispersion (1) used in the first aggregated particle forming process.

Comparative Example 3

A toner (9) is prepared in the same manner as in Example 1, except for changing the silica particles (1) to the silica particles (4) and the amount added thereof to 2.0 parts.

Comparative Example 4

A toner (10) is prepared in the same manner as in Example 1, except for changing the silica particles (1) to the silica particles (5) and the amount added thereof to 1.0 part, and the amount of the titania particles (1) added to 1.5 parts.

Comparative Example 5

A toner (11) is prepared in the same manner as in Example 1, except for changing the silica particles (1) to the silica particles (2) and the amount added thereof to 1.0 part.

Evaluation

The developer is prepared using the toner obtained in each example, and the following evaluation is performed. The results are shown in Tables 1 and 2. For the evaluation of the toner, a modified machine of a DOCUCENTRE II 4000 manufactured by Fuji Xerox Co., Ltd. (image output speed is changed from 45 sheets/min to 50 sheets/min) using a toner reclaiming method is used. The evaluation is performed under the environment of 40° C. and 85% RH.

The developer is prepared as follows.

100 parts of ferrite particles (manufactured by Powdertech, average particle diameter of 50 μm) and 1.5 parts of methyl methacrylate resin (manufactured by Mitsubishi Rayon Co., Ltd., weight average molecular weight of 95,000) are added in a pressurizing kneader with 500 parts of toluene, stirred and mixed at a room temperature (25° C.) for 15 minutes, and heated to 70° C. while being mixed under the reduced pressure to distil away toluene. After that, the mixture is cooled and classified using a sieve of 105 μm, and resin coated ferrite carriers are obtained.

The resin coated ferrite carrier and the toner obtained in each example are mixed with each other, and a developer having a toner density of 7% by weight (two-component electrostatic charge image developer) is prepared.

Evaluation of Toner Coarse Particle

The continuous double-sided image output (image with halftone of 30% with respect to entire surface) of A4 thin paper (ST paper) is performed for 5,000 sheets, the toner in the supply transporting path (see the supply transporting path 74 in FIG. 1) from the cleaning device to the developing device is collected and sieved with a net having an aperture of 106 μm, and the toner coarse powder amount remaining on the net is evaluated based on the following determination criteria.

G1 (A): A weight ratio of the coarse powder amount remaining on the net with respect to the entirety is equal to or less than 2% by weight G2 (B): A weight ratio of the coarse powder amount remaining on the net with respect to the entirety exceeds 2% by weight and is equal to or less than 10% by weight G3 (C): A weight ratio of the coarse powder amount remaining on the net with respect to the entirety exceeds 10% by weight and is equal to or less than 30% by weight G4 (D): A weight ratio of the coarse powder amount remaining on the net with respect to the entirety exceeds 30% by weight.

Evaluation of White Stripe 10,000-sheet output tests using C2 paper are performed sequentially with an image pattern of a square black solid image of 3 cm×3 cm×3 cm on the upper left, the center, and the lower right portions of the sheet. The 10,000-th black solid image and the developing unit blade are observed, and evaluation is performed based on the following determination criteria.

G1 (A): No white stripes are observed in the black solid image, and adhering of the toner to the developing unit blade (layer thickness regulating member) is not observed either G2 (B): adhering of the toner to the developing unit blade is observed, but no white stripes are observed in the black solid image G3 (C): adhering of the toner to the developing unit blade is observed, and white stripes are generated on the black solid image but it is slight G4 (D): white stripes are observed on entire surface of the black solid image.

Evaluation of Photoreceptor Surface Attachment

The same image is used for 10,000-sheet output tests, the attachment on the photoreceptor is observed visually, and evaluation is performed with the following criteria.

G1 (A): Attachment to the photoreceptor is not observed

G2 (B): Attachment to the photoreceptor is observed but it is slight

G3 (C): Attachment, grown in a stripe shape, to the photoreceptor is observed but it is slight G4 (C): Attachment is observed on the substantially entire area of the photoreceptor

TABLE 1

| | | Ex. 1 | Ex. 2 | Ex. 3 | Ex. 4 | Ex. 5 | Ex. 6 |
|---|---|---|---|---|---|---|---|
| Binder resin | | (1) | (1) | (1) | (1) | (1) | (1) |
| Toner | | (1) | (2) | (3) | (4) | (5) | (6) |
| Volume average particle diameter of toner (μm) | | 6.5 | 6.5 | 6.5 | 6.5 | 6.5 | 6.5 |
| Crosslinked resin particles | Type of dispersion | (1) | (2) | (2) | (1) | (1) | (1) |
| | Volume average particle diameter D50v (nm) | 150 | 60 | 60 | 150 | 150 | 150 |
| | Glass transition temperature Tg (° C.) | 65 | 56 | 56 | 65 | 65 | 65 |
| | Presence in surface layer portion* | Observed | Observed | Observed | Observed | Observed | Observed |
| | Area ratio of crosslinked resin particles** | 0.3 | 0.12 | 0.12 | 0.08 | 0.3 | 0.3 |

TABLE 1-continued

| | | Ex. 1 | Ex. 2 | Ex. 3 | Ex. 4 | Ex. 5 | Ex. 6 |
|---|---|---|---|---|---|---|---|
| Silica particles | Type | (1) | (2) | (3) | (1) | (1) | (1) |
| | Volume average particle diameter D50v (nm) | 120 | 40 | 280 | 120 | 120 | 120 |
| | Coverage (%)*** | 68 | 68 | 53 | 68 | 68 | 85 |
| Titania particles | Type | (1) | (1) | (1) | (1) | — | (1) |
| | Volume average particle diameter D50v (nm) | 40 | 40 | 40 | 40 | — | 40 |
| | Coverage (%) | 31 | 31 | 31 | 31 | — | 15 |
| Evaluation | Amount of coarse powder of toner | G1(A) | G2(B) | G2(B) | G3(C) | G3(C) | G2(B) |
| | White stripe | G1(A) | G2(B) | G2(B) | G2(B) | G3(C) | G3(C) |
| | Attachment to surface of photoreceptor | G2(B) | G1(A) | G2(B) | G2(B) | G2(B) | G3(C) |

*Presence in surface layer portion; whether or not there are the crosslinked resin particles in an area within a depth of 300 nm from the surface of the toner particles

**Area ratio of crosslinked resin particles; an area ratio of an area of the crosslinked resin particles and an area excluding the area of the crosslinked resin particles (area of the crosslinked resin particles/area excluding the area of the crosslinked resin particles) in the surface layer portion

***Coverage (%); coverage with respect to the toner particles

TABLE 2

| | | Com. Ex. 1 | Com. Ex. 2 | Com. Ex. 3 | Com. Ex. 4 | Com. Ex. 5 |
|---|---|---|---|---|---|---|
| Binder resin | | (1) | (1) | (1) | (1) | (1) |
| Toner | | (7) | (8) | (9) | (10) | (11) |
| Volume average particle diameter of toner (μm) | | 6.5 | 6.5 | 6.5 | 6.5 | 6.5 |
| Crosslinked resin particles | Type of dispersion | — | (1) | (1) | (1) | (1) |
| | Volume average particle diameter D50v (nm) | — | 150 | 150 | 150 | 150 |
| | Glass transition temperature Tg (° C.) | — | 65 | 65 | 65 | 65 |
| | Presence in surface layer portion | Not observed | Not observed | Observed | Observed | Observed |
| | Area ratio of crosslinked resin particles | 0 | 0 | 0.3 | 0.3 | 0.3 |
| Silica particles | Type | (1) | (1) | (4) | (5) | (2) |
| | Volume average particle diameter D50v (nm) | 120 | 120 | 350 | 20 | 40 |
| | Coverage (%) | 68 | 68 | 53 | 72 | 24 |
| Titania particles | Type | (1) | (1) | (1) | (1) | (1) |
| | Volume average particle diameter D50v (nm) | 40 | 40 | 40 | 40 | 40 |
| | Coverage (%) | 31 | 31 | 31 | 28 | 31 |
| Evaluation | Amount of coarse powder of toner | G4(D) | G4(D) | G3(C) | G4(D) | G4(D) |
| | White stripe | G3(C) | G3(C) | G3(C) | G3(C) | G4(D) |
| | Attachment to surface of photoreceptor | G2(B) | G2(B) | G4(D) | G1(A) | G1(A) |

The evaluation results are shown in Tables 1 and 2. From the results of Tables 1 and 2, in the evaluation of the toner coarse powder amount, it is found that the coarse powder amount is decreased in the examples, compared to the comparative examples. Also in the evaluation of white stripe, it is found that the adhesion of the toner to the developing unit blade is decreased and the generation of the white stripe is decreased. Accordingly, it is found that, when the toner of the example is used, the adhesion of the toner particles to each other is prevented, and the clogging in the supply transporting path from the cleaning device to the developing device is prevented.

It is found that, the coarse powder amount and the adhesion of the toner to the developing unit blade are decreased in the examples 1 to 3, compared to the comparative examples 1 and 2 not including the crosslinked resin particles in the surface layer portion.

In addition, it is found that, in the example 1, the coarse powder amount and the adhesion of the toner to the developing unit blade are further decreased, compared to the example 4 in which the area ratio of the crosslinked resin particles in the surface layer portion is less than 0.1, and the example 5 in which only the silica particles are externally added as the external additive.

The examples also have excellent results in the evaluation of the photoreceptor surface attachment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles;

crosslinked resin particles having a glass transition temperature of 55° C. or higher, which are entirely disposed inside of the toner particles and are present within a surface layer of the toner particles, the surface layer being defined as a section of a toner particle that extends a depth of 300 nm from an outer surface of the toner particle; and silica particles disposed on the surface of the toner particles, the silica particles having a volume average particle diameter of 30 nm to 300 nm and a coverage with respect to the toner particle from 50% to 100%, wherein an area ratio of an area of the crosslinked resin particles and an area excluding the area of the crosslinked resin particles (area of the crosslinked resin particles/area excluding the area of the crosslinked resin particles) in a cross section of the surface layer portion is from 0.1 to 0.5, and the crosslinked resin particles are selected from a styrene crosslinked polymer, a (meth)acrylic crosslinked polymer, and a styrene-(meth)acrylic crosslinked polymer.

2. The electrostatic charge image developing toner according to claim 1, wherein the toner particles further contain titania particles, a coverage of the silica particles with respect to the toner particle is from 10% to 90%, and a coverage of the titania particles with respect to the toner particle is from 10% to 50%.

3. The electrostatic charge image developing toner according to claim 1, wherein a glass transition temperature of the crosslinked resin particles is from 60° C. to 65° C.

4. The electrostatic charge image developing toner according to claim 1, wherein a volume average particle diameter of the crosslinked resin particles is from 70 nm to 300 nm.

5. The electrostatic charge image developing toner according to claim 1, wherein a weight average molecular weight of the crosslinked resin particles is from 30,000 to 200,000.

6. An electrostatic charge image developer comprising the electrostatic charge image developing toner according to claim 1 and a carrier.

7. A process cartridge comprising:

a developing unit comprising the electrostatic charge image developer according to claim 6, the developing unit configured to develop an electrostatic charge image formed on a surface of an image holding member as a toner image with the electrostatic charge image developer, wherein the process cartridge is detachable from an image forming apparatus.

8. An image forming apparatus comprising:

an image holding member;

a charging unit that charges a surface of the image holding member;

an electrostatic charge image forming unit that forms an electrostatic charge image on a charged surface of the image holding member;

a developing unit comprising the electrostatic charge image developer according to claim 6, the developing unit configured to develop the electrostatic charge image formed on the surface of the image holding member as a toner image with the electrostatic charge image developer;

a transfer unit that transfers the toner image formed on the surface of the image holding member onto a surface of a recording medium; and a fixing unit that fixes the toner image transferred onto the surface of the recording medium.

9. A toner cartridge comprising:

a container comprising therein the electrostatic charge image developing toner according to claim 1, wherein the container is detachable from an image forming apparatus.

10. The electrostatic charge image developing toner according to claim 1, wherein the toner particles are obtained by:

preparing a first resin particle dispersion in which first resin particles are dispersed, aggregating the first resin particles, and forming first aggregated particles;

mixing (a) a first aggregated particle dispersion in which the first aggregated particles are dispersed, (b) a second resin particle dispersion in which second resin particles are dispersed and (c) a crosslinked resin particle dispersion in which crosslinked resin particles are dispersed to form a second mixture, aggregating the particles in the second mixture so as to adhere the second resin particles and the crosslinked resin particles to the surface of the first aggregated particles, and forming second aggregated particles; and heating a second aggregated particle dispersion in which the second aggregated particles are dispersed, to coalesce the second aggregated particles, thereby forming the toner particles.

11. The electrostatic charge image developing toner according to claim 10, wherein the same resin particles are used for the first resin particles and the second resin particles.

12. The electrostatic charge image developing toner according to claim 1, wherein the crosslinked resin particles are a styrene crosslinked polymer.

13. The electrostatic charge image developing toner according to claim 1, wherein the crosslinked resin particles are a (meth)acrylic crosslinked polymer.

14. The electrostatic charge image developing toner according to claim 1, wherein the crosslinked resin particles are a styrene-(meth)acrylic crosslinked polymer.

15. The electrostatic charge image developing toner according to claim 1, wherein the area ratio is from 0.15 to 0.45.

* * * * *